US005605434A

United States Patent [19]

Haag et al.

[11] Patent Number: 5,605,434

[45] Date of Patent: Feb. 25, 1997

[54] IMPELLER HAVING TRANSPORT ELEMENTS DISPOSED ON A PRESSURE SIDE OF A COVER DISK FOR A CENTRIFUGAL PUMP FOR DIRTY LIQUIDS

[75] Inventors: Christian Haag, Halle; Christoph Jaeger, Gerolsheim; Wolfgang Kochanowski, Windesheim; Thomas Pensler, Langenbogen; Rolf Witzel, Ebersburg/Weyhens, all of Germany

[73] Assignee: KSB Aktiengesellschaft, Frankenthal, Germany

[21] Appl. No.: 536,956

[22] Filed: Sep. 29, 1995

[30] Foreign Application Priority Data

Sep. 30, 1994 [DE] Germany ..... 44 35 192.5

[51] Int. Cl.[6] ..... F04D 29/22

[52] U.S. Cl. ..... 415/106; 416/203

[58] Field of Search ..... 415/106, 174.3; 416/186 R, 203

[56] References Cited

U.S. PATENT DOCUMENTS

| | | | |
|---|---|---|---|
| 495,760 | 4/1893 | Seitz | 416/186 R |
| 2,361,521 | 10/1944 | Yates | 415/106 |
| 2,853,019 | 9/1958 | Thornton | 415/106 |
| 3,123,010 | 3/1964 | Witt et al. | 415/106 |
| 3,663,117 | 5/1972 | Warren | 415/106 |
| 3,732,032 | 5/1973 | Daneel | 416/186 R |
| 3,953,146 | 4/1976 | Sowards . | |
| 4,349,322 | 9/1982 | Stahle . | |
| 4,378,196 | 3/1983 | Leskinen | 415/106 |
| 4,820,115 | 4/1989 | Bandukwalla | 415/106 X |
| 4,854,830 | 8/1989 | Kozawa et al. | 415/55.1 |
| 5,320,482 | 6/1994 | Palmer et al. | 415/174.3 |

FOREIGN PATENT DOCUMENTS

| | | |
|---|---|---|
| 0244844 | 5/1987 | European Pat. Off. . |
| 4400289A1 | 1/1994 | Germany . |
| 4431947A1 | 8/1994 | Germany . |
| 1142488 | 2/1973 | United Kingdom . |
| 2222207 | 8/1989 | United Kingdom . |
| 2236696 | 4/1991 | United Kingdom . |

*Primary Examiner*—F. Daniel Lopez
*Assistant Examiner*—Michael S. Lee
*Attorney, Agent, or Firm*—Darby & Darby

[57] ABSTRACT

An impeller of a centrifugal pump for transporting dirty liquids has transport elements, for example back-vanes or grooves disposed on the pressure side of a cover disk. The transport elements are arranged asymmetrically and are limited to one arc sector of the cover disk to create a transverse stream that rotates with the impeller. Solids which have penetrated into the space to the side of the wheel are carried out by this stream in the direction of the transport elements.

6 Claims, 1 Drawing Sheet

IMPELLER HAVING TRANSPORT ELEMENTS DISPOSED ON A PRESSURE SIDE OF A COVER DISK FOR A CENTRIFUGAL PUMP FOR DIRTY LIQUIDS

BACKGROUND OF THE INVENTION

1. Field of the Invention

The present invention relates to an impeller for transporting dirty liquid. More specifically, the present invention relates to an impeller having transport elements disposed on a pressure side of a cover disk of the impeller.

2. Discussion of the Related Art

In centrifugal pumps which transport dirty liquids, it is absolutely essential to keep the space on the pressure side of the impeller free of admixtures of the liquid that is being transported to prevent deposits from baking on solidly and to minimize the wear on seals. To achieve this goal, the cover disk of the impeller of such a pump conventionally has a large number of vanes disposed on the back or pressure side of the impeller. These vanes are distributed symmetrically over the surface of the cover disk, and rotate at a slight distance from the housing wall. The vanes on the back of the impeller cause the circumferential component of the liquid stream on the pressure side of the wheel to match the circumferential speed of the impeller. The vanes generate a more or less strong radial pressure gradient, which is always directed concentrically with respect to the impeller. The radial pressure gradient is supposed to prevent dirt and fibers from penetrating into the rear hub region of the impeller. However, a secondary stream also results. The primary stream is directed radially outward near the cover disk and the secondary stream is directed radially inward near the housing wall. This stream transports radially outward such solids whose density is greater than the average density of the transport medium. However, solids whose density is less than the average density of the transport medium are transported radially inward. Once such solids have reached the hub region of the impeller, where there is a region of low pressure, they can no longer be seized by the primary stream of the back-vanes, and cannot be transported to the periphery of the impeller. These solids therefore remain in the hub region, where they can cause a great deal of trouble. Increased wear, caking, and baked-on adhesions can thus occur in the hub region which creates the risk that the pump rotor will be blocked and that the seal will fail.

It is an object of the present invention to provide an impeller which prevents the creation of a region where depositions of solids are possible.

SUMMARY OF THE INVENTION

The object of the present invention is achieved by an asymmetric arrangement of the transport elements, limited to an arc sector of the cover disk on the pressure side.

The asymmetric arrangement of the transport elements achieves a transverse flow, rotating with the impeller, on the pressure side of the wheel. The result of this rotating transverse flow is that solids which have penetrated into the space on the pressure side of the impeller cover disk cannot deposit there but are transported back into the transport stream of the centrifugal pump. The arcuate sector of transport elements on the cover disk of the pressure side can be kept very small. In a preferred embodiment, the angle of the arc sector should be at most 120°. In fact, even a single vane or groove is sufficient to achieve a transverse flow through the lateral space of the wheel, this flow rotating together with the impeller.

The inventive solution is especially suited for pumps with single-vane wheels, because single-vane wheels naturally have a pressure distribution that is not uniform over the circumference of the impeller. The existing pressure gradient is used and reinforced by the inventive solution, if the inventive transport elements are disposed at the circumference of the impeller at the region of lowest pressure (i.e., diametrically opposite of the outlet for the single-vane impeller). A welcomed side effect of this embodiment is a partial equalization of the hydraulic unbalance induced by the single-vane impeller.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Figure 1:
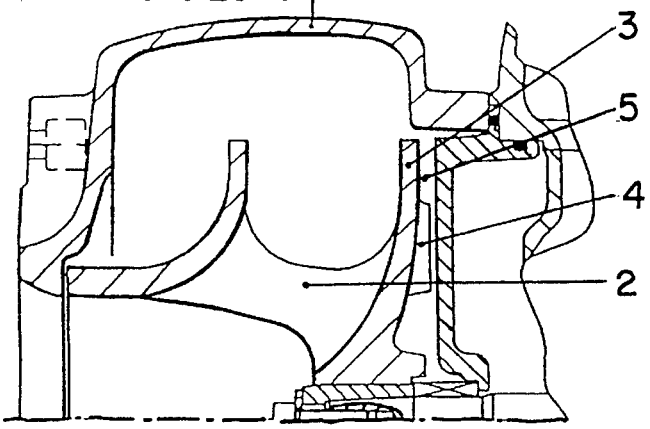
FIG. 1 is a partial sectional view of a centrifugal pump which has an impeller having vanes disposed on a rear surface of a cover disk.

Referring now to FIG. 1, a centrifugal pump is shown having an impeller 2 disposed in a housing 1. Impeller 2 is preferably a two-channel wheel (only one channel is shown) for the purpose of transporting dirty water. The impeller 2 has a cover disk 3 disposed on one side of the impeller. A plurality of back-vanes 4 are disposed on the pressure or rear side of the cover disk 3 of the impeller 2. The back-vanes 4 are transport elements whose effect are to propel material in the radial outward direction back-vanes 4 extend over the entire space 5 on the pressure side of the centrifugal pump.

Figure 2:
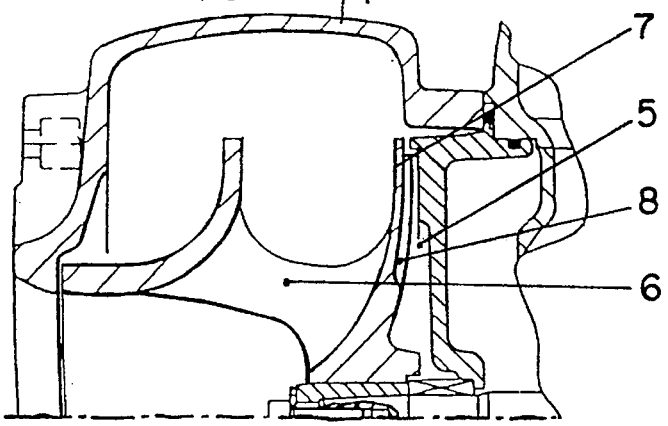
FIG. 2 is a partial view of a second embodiment of a centrifugal pump in which the transport elements are grooves in the rear surface of the cover disk.
Figure 3:
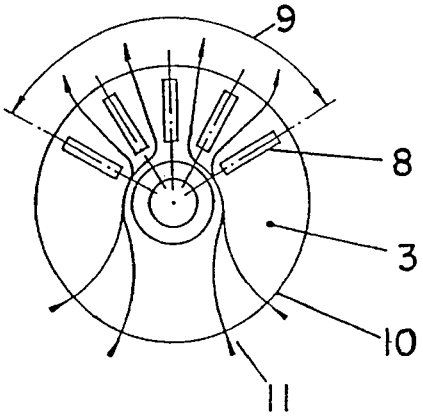
FIG. 3 is a plan view of the rear surface of the cover disk shown in FIG. 2.

Instead of back-vanes 4, other transport elements can also be used. Thus, FIG. 2 shows another embodiment of an impeller 6 according to the present invention. This embodiment has grooves 8 disposed in the pressure side of the cover disk 7. FIG. 3 shows the arrangement of the grooves 8 within an arc sector 9 (whose angle is about 120°). The back-vanes 4 of FIG. 1 are also arranged in a substantially similar manner.

When the impeller 2 is rotating, the asymmetrically arranged transport elements, back vanes 4 or grooves 8, build up a pressure in the region of arc 9, which is higher than the pressure prevailing on the opposite side 10 of the impeller 2. This creates a transverse stream 11 in the space 5 on the pressure side of the wheel. The transverse stream rotates with the impeller 2, and is symbolically illustrated by lines 11 in FIG. 3. Solids which have penetrated into the space 5 are carried out by this rotating transverse stream in the direction of the transport elements (i.e., back-vanes 4 or grooves 8).

Figure 4:
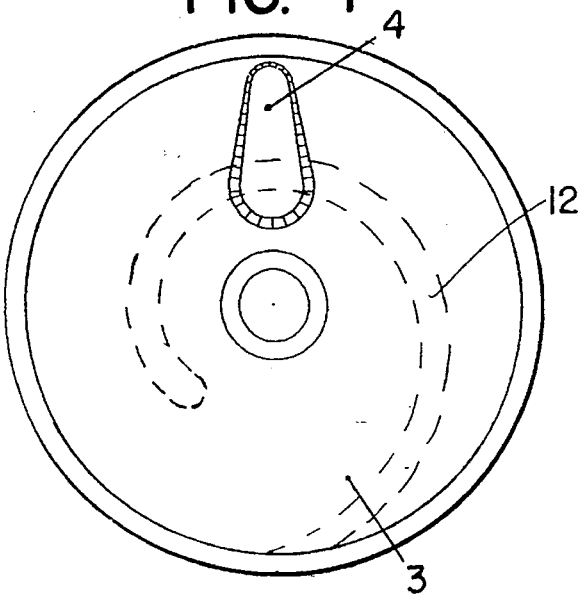
FIG. 4 is a plan view of the rear surface of the cover disk of an alternate embodiment of the present invention.

FIG. 4 shows one back-vane 4 disposed on the pressure side of the cover disk 3. In this embodiment, the impeller may be a single-vane impeller 12, which is shown in phantom (i.e., in dotted lines) because it is disposed on the suction or front side of disk 3.

Having described the presently preferred exemplary embodiment of a new and improved impeller having transport elements disposed on a pressure side of a cover disk for a centrifugal pump for dirty liquids in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

We claim:

1. An impeller for transporting dirty liquids, said impeller comprising:

a cover disk having a suction side and a pressure side, said cover disk having at least one transport element disposed on said pressure side of said cover disk, said at least one transport element being asymmetrically disposed on said cover disk within an arc sector of a predetermined angle, said predetermined angle being less than 360°.

2. The impeller according to claim 1, wherein the predetermined angle of said arc sector is less than or equal to 120°.

3. The impeller according to claim 1, wherein said at least one transport element comprises one transport element disposed on the pressure side of the cover disk.

4. The impeller according to claim 1, wherein the impeller is single-vane impeller, the at least one transport element is disposed at the circumference of the impeller substantially in the region of lowest pressure.

5. The impeller according to claim 1, wherein said at least one transport element is at least one vane.

6. The impeller according to claim 1, wherein said at least one transport element is at least one groove disposed in the pressure side of said cover disk.

* * * * *